US009946228B2

(12) United States Patent
Heusler et al.

(10) Patent No.: US 9,946,228 B2
(45) Date of Patent: Apr. 17, 2018

(54) TOOL-POST FOR OPERATIONS ON TIMEPIECE MOVEMENTS

(71) Applicant: OMEGA SA, Biel/Bienne (CH)

(72) Inventors: Christophe Heusler, Bienne (CH); Daniel Zumsteg, Ruettenen (CH)

(73) Assignee: Omega SA, Biel/Bienne (CH)

( * ) Notice: Subject to any disclaimer, the term of this patent is extended or adjusted under 35 U.S.C. 154(b) by 421 days.

(21) Appl. No.: 14/662,601

(22) Filed: Mar. 19, 2015

(65) Prior Publication Data

US 2015/0277385 A1 Oct. 1, 2015

(30) Foreign Application Priority Data

Mar. 27, 2014 (EP) ..... 14162057

(51) Int. Cl.

| | |
|---|---|
| ***B25B 1/08*** | (2006.01) |
| ***G04D 3/00*** | (2006.01) |
| ***G04D 1/00*** | (2006.01) |
| ***G04D 1/06*** | (2006.01) |

(52) U.S. Cl.

CPC ..... *G04D 3/00* (2013.01); *G04D 1/0021* (2013.01); *G04D 1/06* (2013.01); *Y10T 29/53639* (2015.01)

(58) Field of Classification Search

USPC ..... 269/226, 228, 231, 233, 234

See application file for complete search history.

(56) References Cited

U.S. PATENT DOCUMENTS 2,471,103 A * 5/1949 Franks ..... G04D 1/025 206/18
5,556,085 A * 9/1996 Cyr ..... B25B 1/22 269/156
6,612,589 B2 * 9/2003 Saito ..... B23B 31/16275 279/110
8,496,216 B2 * 7/2013 Isobe ..... B60R 11/0235 248/220.21
9,140,402 B2 * 9/2015 Anderson ..... F16M 11/04
2006/0186301 A1 * 8/2006 Dozier ..... F16M 11/043 248/371
2012/0273630 A1 * 11/2012 Gillespie-Brown . F16M 11/041 248/122.1

FOREIGN PATENT DOCUMENTS

| | | |
|---|---|---|
| CH | 366 002 | 11/1962 |
| CH | 856 063 | 7/1963 |
| CH | 380 660 | 3/1964 |
| CH | 485 511 | 2/1970 |
| GB | 1 083 443 | 9/1967 |

OTHER PUBLICATIONS

European Search Report dated Dec. 9, 2014 in European Application 14162057, filed on Mar. 27, 2014 ( with English Translation).

* cited by examiner

*Primary Examiner* — Joseph J Hail
*Assistant Examiner* — Shantese McDonald
(74) *Attorney, Agent, or Firm* — Oblon, McClelland, Maier & Neustadt, L.L.P.

(57) ABSTRACT

The present invention concerns a device for performing operations on timepiece movements including a plate mounted on a stand, said plate including at least one storage area capable of receiving timepiece movement components, characterized in that said plate further includes at least one work support provided with means for holding timepiece movements, the work support being arranged to form an extension so as to facilitate access to said movement.

23 Claims, 4 Drawing Sheets

TOOL-POST FOR OPERATIONS ON TIMEPIECE MOVEMENTS

This application claims priority from European patent Application 14162057.5 filed Mar. 27, 2014, the entire disclosure of which is hereby incorporated herein by reference.

The present invention concerns the field of devices for performing operations on timepiece movements. These devices include a plate mounted on a stand, said plate including at least one storage area capable of receiving timepiece movement components.

PRIOR ART

There are known tools for performing operations on timepiece movements, such operations may be the construction or repair of these movements. In general, the construction or repair of timepiece movements takes place on a movement-holder, defined as a support with two jaws whose shape is adapted to the movement to hold it during work.

Thus, for the construction or repair of a movement, the movement is fixed, via its main plate, to the movement-holder. The operator can then assemble or disassemble the movement. Storage boxes are used for storing the various parts: parts to be assembled, disassembled parts, spare parts, all of which are placed on a work bench allowing the operator to access the parts.

However, one drawback of this work configuration is that it does not optimise the operator's time, since it does not permit work to be performed in series.

Indeed, in the case of a service or repair operation, the operator takes the movement to be serviced/repaired, fixes it to a movement-holder and takes the parts he will need for the operation on the movement. Once this operation is finished, the operator stores the various parts and takes another movement to perform an operation there on; said operation may be similar to the preceding one.

Thus, it is not possible to envisage the servicing in series of timepiece movements with the current configuration since the appropriate tools and processes are not available.

The servicing is even less likely when there is one operator per step, that is to say one operator for disassembly, one operator for repair and one operator for performing checks.

SUMMARY OF THE INVENTION

It is therefore an object of the present invention to overcome the drawbacks of the prior art by providing a device enabling operations to be performed in series on timepiece movements.

To this end, the invention concerns a device for performing operations on timepiece movements including a plate mounted on a stand, said plate including at least one storage area capable of receiving timepiece movement components, characterized in that said plate further includes at least one work support provided with means for holding timepiece movements, the work support being arranged to form an extension so as to facilitate access to said movement.

In a first advantageous embodiment, the work support includes a platform having a peripheral edge and holding means for holding a timepiece movement.

In a second advantageous embodiment, the platform includes an orifice in which the holding means are arranged, these holding means including a shim mounted on a tube associated with a worm for modifying the position of the shim and thereby adapting to different sized movements.

In a third advantageous embodiment, the holding means further include a spring allowing said shim to be moved elastically.

In a fourth advantageous embodiment, said storage surface includes at least one storage area.

In another advantageous embodiment, said storage area is a hollow.

In another advantageous embodiment, said storage area is an opening in which a receptacle is inserted.

In another advantageous embodiment, said plate is mounted to pivot relative to the stand.

In another advantageous embodiment, the device further includes a click system for locking the position of the plate relative to the stand.

In another advantageous embodiment, said plate includes five storage surfaces, each associated with a work support.

BRIEF DESCRIPTION OF THE DRAWINGS

The objects, advantages and features of the device according to the present invention will appear more clearly in the following detailed description of at least one embodiment of the invention, given solely by way of non-limiting example and illustrated by the annexed drawings, in which.

DETAILED DESCRIPTION OF THE INVENTION

Figure 1:
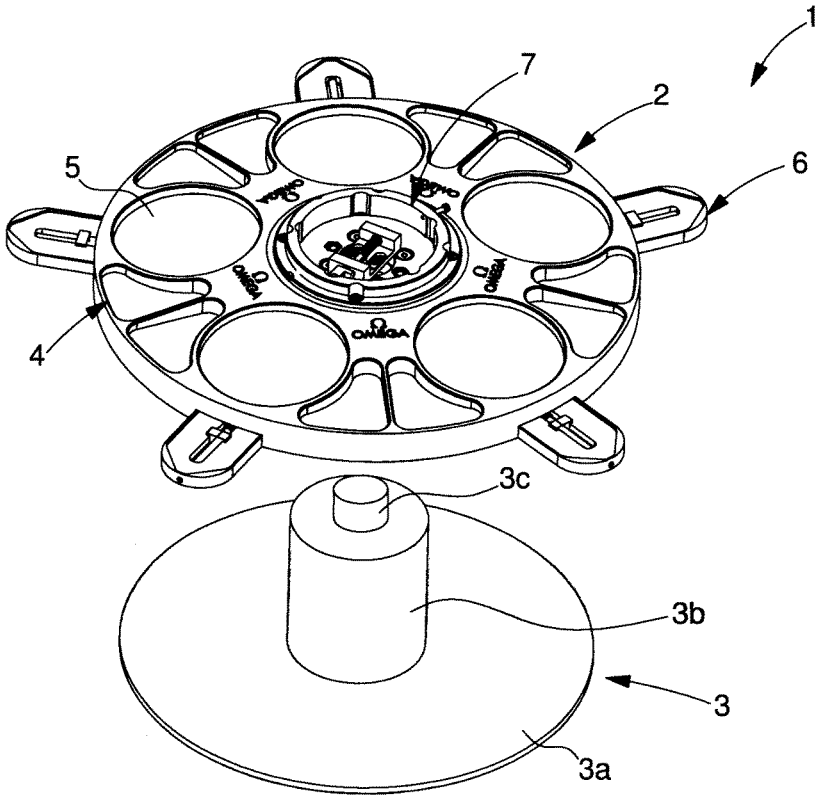
FIG. 1 is a schematic view of the device for working on timepiece movements according to the invention.

FIG. 1 shows a device 1 according to the invention. This device 1 is used to perform assembly, disassembly, servicing operations on at least one timepiece movement, which may be an electronic, mechanical or electromechanical movement.

Device 1 includes a circular plate 2. This circular plate 2 is mounted on a stand 3. Stand 3 includes a base 3*a* from which extends a tool-post 3*b* whose height is such that when the user is working on device 1, plate 2 is at the work height of the watchmaker, i.e. when the latter places his arms on the worktable, plate 2 is at a short distance.

Plate 3 includes at least one storage surface 4. This storage surface 4 is used for storage of the various timepiece components. In the case of servicing of a timepiece movement, the operator has to juggle between the disassembled parts, defective parts and replacement parts.

Storage surface 4 is thus provided with several receiving areas 5 in each of which different types of parts are placed. For example, in the case of servicing of a timepiece movement, storage surface 4 is provided with three receiving areas: a central area for disassembled parts, one for defective parts and one for replacement parts. The central receiving area 5 can then be used for receiving cleaning baskets so that during the course of operations, the movement is disassembled by an operator, with the defective parts being placed in the receiving area 5 for defective parts. The other dismantled parts of the movement are placed in one or more cleaning baskets in central receiving area 5 to be cleaned. When the movement is re-assembled, the parts located in the cleaning basket(s) are re-assembled in the movement, whereas the defective parts are replaced by new parts taken from receiving area 5 for replacement parts.

These receiving areas 5 may, in a first embodiment, take the form of hollows. This means that each receiving area 5 is an area of plate 2 which is hollowed in a particular shape. These hollows are capable of receiving the different parts and of holding the various parts on the plate, preventing them from sliding.

In an alternative to this first embodiment, receptacles may be placed in the hollows.

In a second embodiment, receiving areas 5 take the form of openings in each of which a receptacle is inserted, this receptacle containing the various parts of the timepiece movement. For example, the receptacle is a cleaning basket. These receptacles may be stacked on top of each other. The advantage of this second embodiment is that it permits pre-packing of different types of parts in the receptacles. Further, this allows the various receptacles to be interchanged with each other instead of being emptied and the filled with other parts. Indeed, where cleaning baskets are used, the non-defective parts to be cleaned are placed in the baskets when they are dismantled and remain in the cleaning baskets throughout the operations on the movement.

Of course, it can be provided to mix the first and second embodiment so that some receiving areas 5 take the form of a hollow and so that other receiving areas 5 take the form of an opening.

Figure 3A:
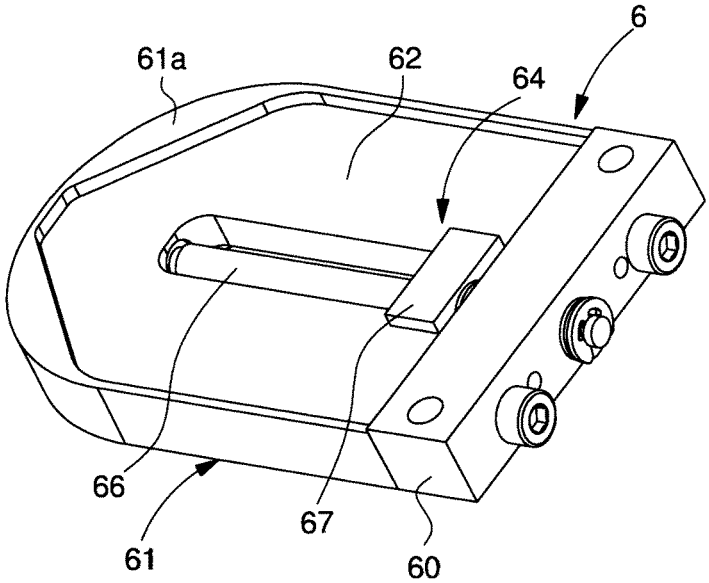
FIGS. 3A, 3B, 3C are different schematic views of a peripheral support of the device for working on timepiece movements according to the invention.
Figure 3B:
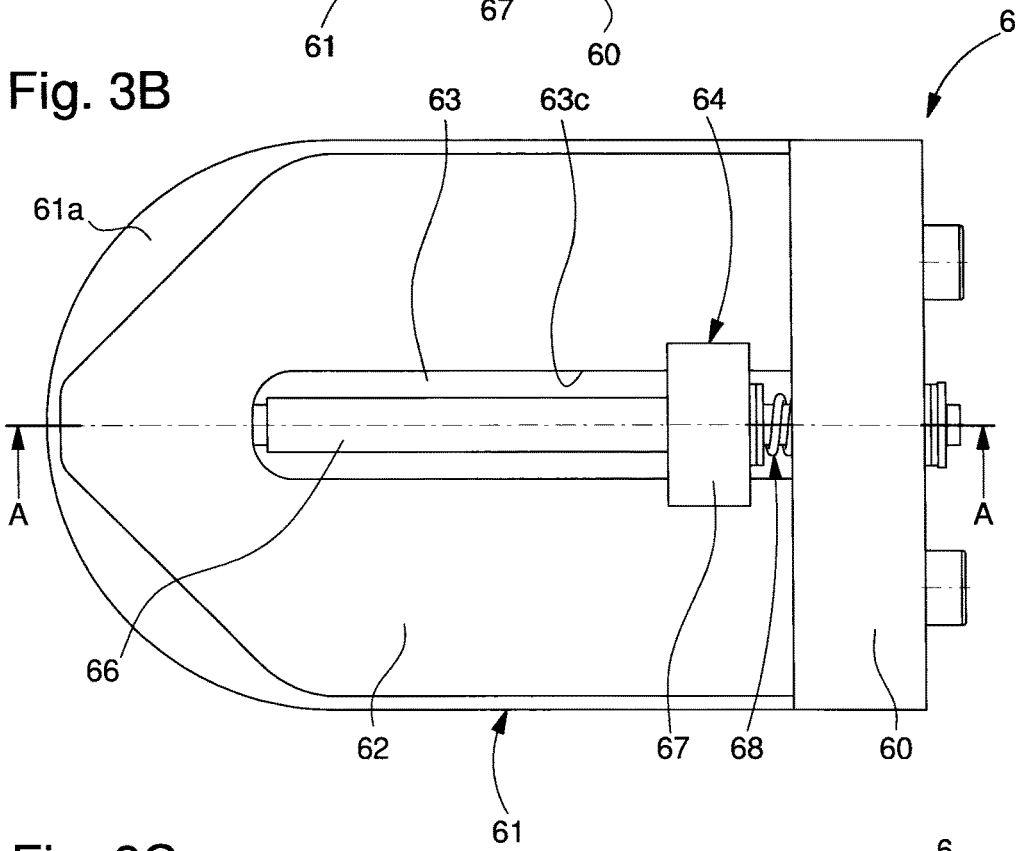
Figure 3C:
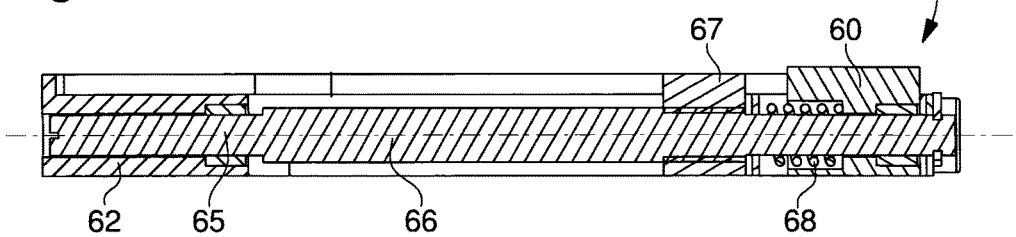

Advantageously according to the invention, the plate also includes at least one work support 6 visible in FIGS. 3A, 3B and 3C. This work support 6 is used so that the timepiece movement can be placed thereon during the various operations that it will undergo. This work support 6 is arranged on the periphery of plate 2. The work support 6 includes a cross-piece 60 of parallelepiped section to which a platform 61 is fixed. This platform 61 is substantially similar to a U-shape, that is to say this platform 61 includes two parallel branches 62 connected to each other by one of their ends, a space 63 being present between the two branches 62. Cross-piece 60 is used to fix support 6 to plate 2, preferably on the under surface of plate 2, i.e. the surface facing the ground. Platform 61 includes a peripheral edge 61*a* permitting the movement to rest thereon. Peripheral edge 61*a* at the connection between the two branches 62 may be created to be rounded or to form at least one angle for improved hold of the movement-holder. Peripheral edge 61*a* at the connection between the two branches 62 may thus have a triangular shape.

Platform 61 is provided with means 64 for holding the timepiece movement. More particularly, holding means 64 are used to hold the movement, which is mounted on a movement-holder. In space 63 present between two parallel branches 62 of platform 61, a holding module 64 is arranged. This holding module 64 includes a tube 66 mounted on a worm 65, disposed along space 63. This worm 65 allows tube 66 to be moved forward or backwards. Tube 66 is associated with a shim 67 such that the latter is moved jointly with said tube 66. The position of shim 67 is thus modified to adapt to movements or movement-holders of different sizes. This shim 67 and the longitudinal sides 63*a* of space 63 between the two branches 62 of platform 61 may be configured such that said shim 67 is rail mounted.

Holding means 64 are also arranged to be elastically mounted. To achieve this, tube 66 is also associated with a spring 68 used for holding the timepiece movement.

Indeed, holding means 64 are used so that the operator can first of all adjust the position of shim 67 to the size of the movement-holder so that the latter can be held by acting on worm 65. The elastic mounting of holding means 64 enables shim 67 to be acted upon, when the movement-holder is placed on work support 6, so as to momentarily modify the position of the shim so that the movement-holder can be set in place. The movement of the shim may be a distance of around 2 to 3 mm. This ability to be moved is similar to play, i.e. the position of the shim is not completely fixed and it can be moved slightly and adapted to fit. Once the movement-holder has been placed on work support 6, the operator releases shim 67 from the stress exerted thereon so that the shim returns to its initial position, i.e. in the position held before the operator applied stress. In this case, shim 67 exerts a force on the movement-holder which then bears on the peripheral edge 61*a* of work support 6 causing immobilisation of the movement-holder.

Cleverly, the fact of mounting shim 67 on the spring with some play in its position allows it to be adapted to fit different types of movement-holder. Indeed, these movement-holders may have rough portions or flat portions or not be completely circular and thus have a substantially oval or elliptical shape.

In the absence of any play, the operator who releases the movement-holder from work support 6 would have to do so by re-engaging it in the same angular position. Further, the operator would not be able to rotate the movement-holder on its axis when the movement-holder is engaged on work support 6.

With a shim 67 having some play so that it can be moved by several millimeters, it becomes possible to rotate the movement-holder on its axis when it is engaged on work support 6. Rough portions or flat portions lead to the appearance of stress exerted on shim 67, or the disappearance/reduction of the force exerted by shim 67 on the movement-holder. This results in a movement of said shim 67 to obtain permanent and optimum holding of the movement-holder on support 6.

The advantage of having this peripherally placed work support 6 is that it allows the operator to work directly on device 1. Indeed, the fact that support 6 is at the periphery of plate 2 results in the appearance of a free space around said support 6, facilitating access to the movement by the operator who can then work on the movement while it is placed on device 1.

In a first variant, plate 2 includes a plurality of storage surfaces 4, each being provided with several receiving areas 5. A different type of part is placed in each receiving area 5. These storage surfaces 4 are angularly distributed over the plate. In a preferred version of this first variant, plate 2 is provided with five angularly distributed storage surfaces 4, but this number is not limiting as there may be 2, 3, 4, 6 or even more storage surfaces 4.

This variant has the advantage of allowing the operator to perform work in series on several timepiece movements. Without doubt, this configuration allows the operator to work on a first movement, then to move onto a second movement and so on. Preferably, the same type of operation is performed for each movement placed on device 1.

Figure 4:
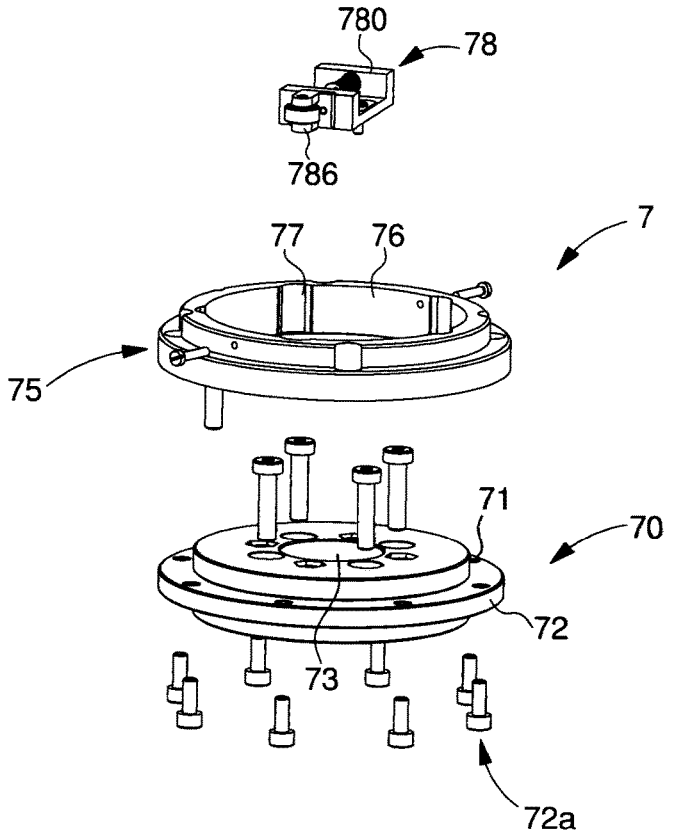
FIGS. 4 and 5 are schematic views of the click system of the device for working on timepiece movements according to the invention.
Figure 5:
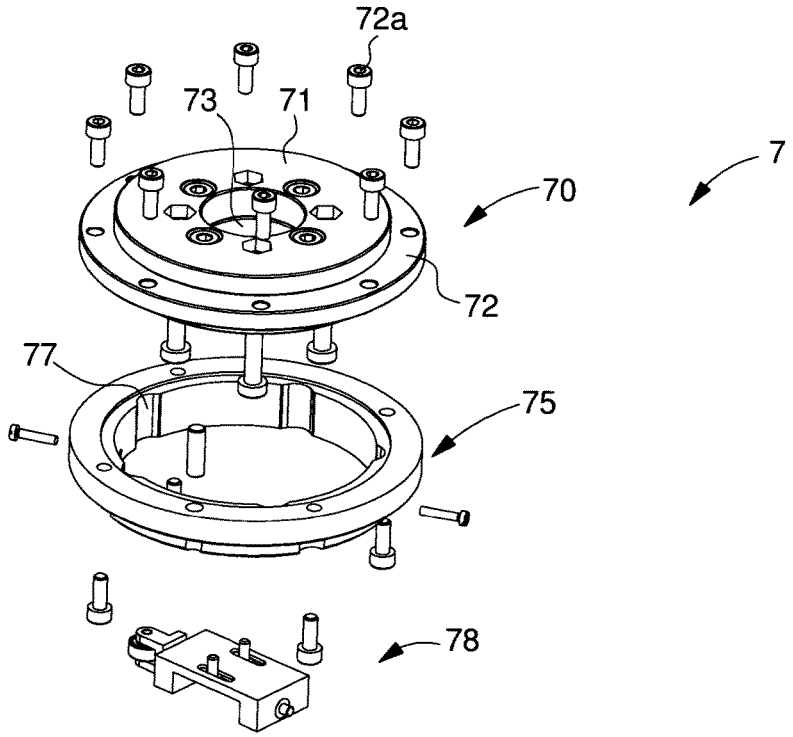

In a second variant, compatible with the first variant, the plate is rotatably mounted on stand 3. To prevent permanent rotation, plate 2 is provided with a click system 7 visible in FIGS. 4 and 5. To achieve this, plate 2 includes at its centre an orifice 8 in which click system 7 is arranged in order to lock the angular position of plate 2. This click system 7 includes a disc-shaped hub 70. This hub 70 takes the form of three superposed discs, the central disc 72 having a larger diameter than the other two discs 71. This larger diameter of central disc 72 allows the latter to cooperate with plate 2. Indeed, at its orifice 8, plate 2 has an annular area 8*a* of smaller thickness whose dimensions are identical to those of central disc 72. Central disc 72 is used to fix hub 72 to plate 2. Click system 7 also includes an annular guide part 75 whose inner wall 76 is hollowed.

This annular guide part 75 is sized to cooperate with plate 2 present at annular area 8*a* of orifice 8 During assembly, this is achieved such that annular area 8*a* of orifice 8 of plate 2 is inserted between hub 70 and annular guide part 75, hub 70 then being placed underneath plate 2. Securing means 72*a*, such as screws, are used to join these various elements.

Figure 6:
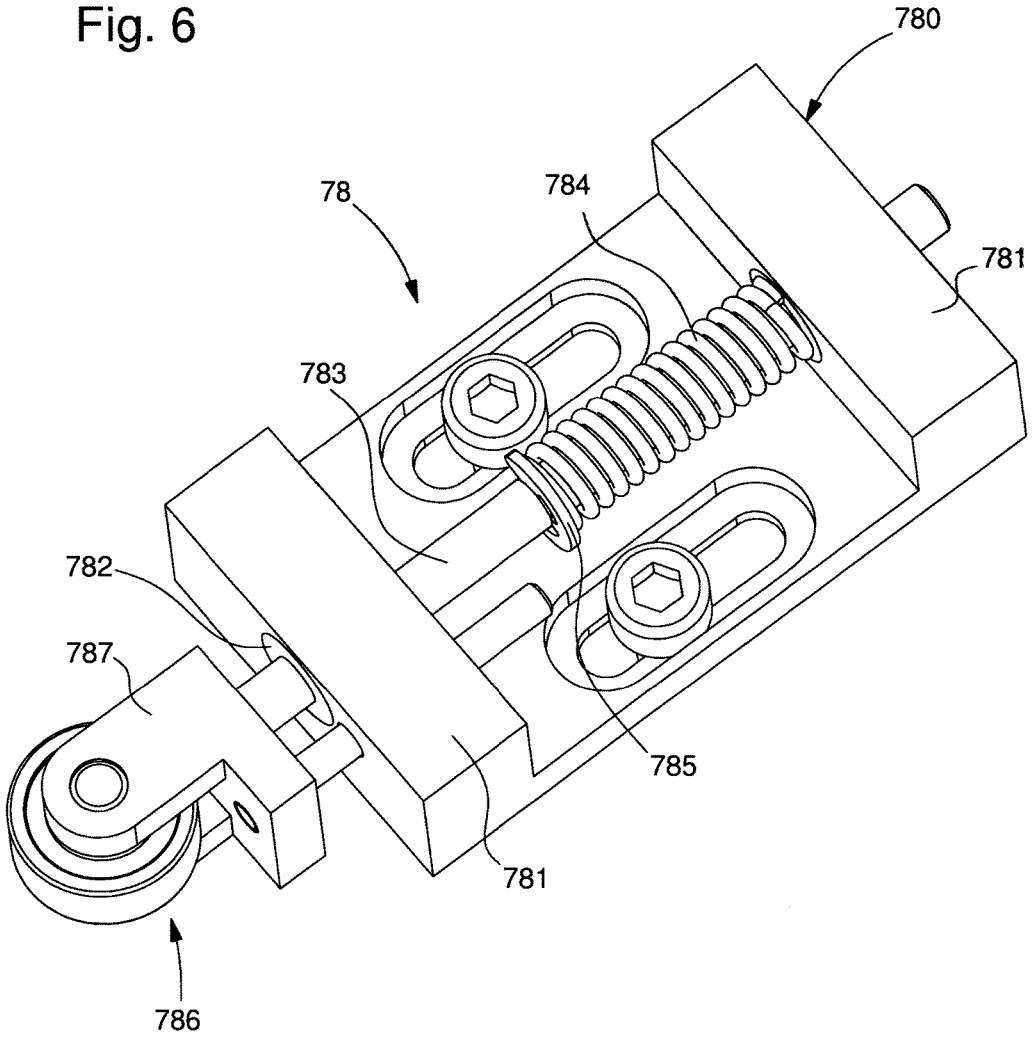
FIG. 6 is a schematic view of the locking head of the click system of the device for working on timepiece movements according to the invention.

Hub 70 further has a hole 73 for mounting plate 2 on stand 3. Indeed, the tool-post 3*b* further includes a circular stud 3*b* whose dimensions enable it to be inserted into hole 73 of hub 70. The click system 7 further includes an angular position locking element 78 visible in FIG. 6. This locking element 78 is mounted on stud 3*c* of the tool-post. This angular position locking element 78 includes a frame 780 that is preferably U-shaped with two parallel branches 781. These two branches 781 each have an opening 782. A pin 783 is mounted in these openings 782. Pin 783 is associated with a spring 784. Pin 783 includes a ring 785 so that spring 784 is placed between ring 785 and one of branches 781. The free end of the inner tube has a locking head 786. This locking head 786 includes a structure 787 in which a wheel 788 is mounted. Locking head 786 is configured to cooperate with the inner wall 76 of annular guide part 75. Indeed, the inner wall 76 of annular guide part 75 is hollowed to exhibit notches 77 into which locking head 786 can be inserted. The number of notches is equal to the number of storage surfaces 4. When the operator wishes to rotate plate 2, the force exerted by the operator is applied to locking element 78. More specifically, the force is applied to locking head 786 causing a movement of tube 783 and consequently a compression of spring 784. This movement thus releases plate 2 so that it can rotate. When locking head 786 is facing a notch 77 of inner wall 76, the stress exerted on locking head 786 decreases so that spring 784 of locking element 78 relaxes. Consequently, tube 783 moves and returns to its rest position and locking head 786 cooperates with said notch 77.

Figure 2:
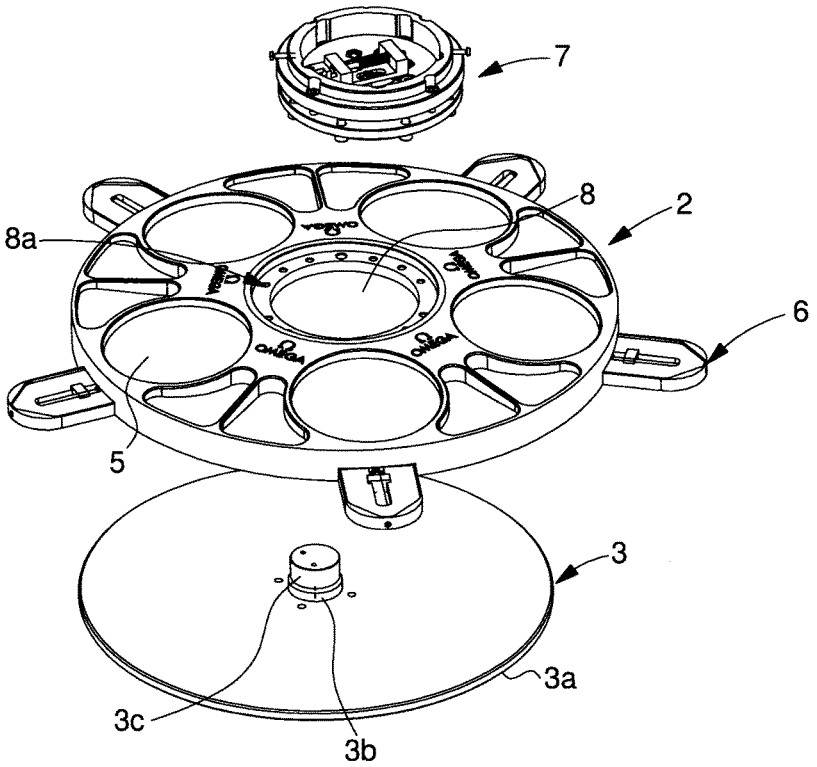
FIG. 2 is a schematic view of a variant of the device for working on timepiece movements according to the invention.

In a variant visible in FIG. 2, the height of tool-post 3*b* may be virtually zero according to the arrangement of the operator's work surface tool-post 3*b* which includes stud 3*c* inserted into the hole of the hub thus form a single piece so that plate 2 and base 3*a* of stand 3 are almost in contact.

It will be clear that various alterations and/or improvements evident to those skilled in the art may be made to the various embodiments of the invention described in this description without departing from the scope of the invention.

What is claimed is:

1. A device for performing operations on timepiece movements, comprising:

a plate mounted on a stand, said plate including at least one storage surface capable of receiving timepiece movement components, wherein said plate further includes at least one work support, the work support being arranged to form an extension so as to facilitate access to said movement, and wherein the work support includes a U-shaped platform including a tube mounted in the U-shaped platform and a shim protruding up from a top face of the U-shaped platform and mounted to move with the tube, the U-shaped platform including a raised peripheral edge extending along an outer edge of the U-shaped platform such that the timepiece movements can be held between the shim and the raised peripheral edge.

2. The device according to claim 1, wherein a worm is mounted on a first end of the shim for modifying the position of the shim and thereby adapting to fit different sized movements.

3. The device according to claim 2, wherein said storage surface has at least one storage area.

4. The device according to claim 3, wherein said storage area is a hollow.

5. The device according to claim 3, wherein said storage area is an opening into which a receptacle is inserted.

6. The device according to claim 2, wherein said plate is mounted to pivot relative to the stand.

7. The device according to claim 6, wherein the device further includes a click system for locking the position of the plate relative to the stand, the click system being arranged in an orifice in a center of the plate, and the click system includes a central disc fixed to the plate and an annular guide plate with a hollow inner wall, an annular area of the orifice being positioned between the central disc and the annular guide plate.

8. The device according to claim 2, wherein a spring is mounted on a second end of the shim allowing said shim to be moved elastically.

9. The device according to claim 8, wherein said storage surface has at least one storage area.

10. The device according to claim 9, wherein said storage area is a hollow.

11. The device according to claim 9, wherein said storage area is an opening into which a receptacle is inserted.

12. The device according to claim 8, wherein said plate is mounted to pivot relative to the stand.

13. The device according to claim 12, wherein the device further includes a click system for locking the position of the plate relative to the stand, the click system being arranged in an orifice in a center of the plate, and the click system includes a central disc fixed to the plate and an annular guide plate with a hollow inner wall, an annular area of the orifice being positioned between the central disc and the annular guide plate.

14. The device according to claim 1, wherein said storage surface has at least one storage area.

15. The device according to claim 14, wherein said storage area is a hollow.

16. The device according to claim 14, wherein said storage area is an opening into which a receptacle is inserted.

17. The device according to claim 14, wherein said plate is mounted to pivot relative to the stand.

18. The device according to claim 17, wherein the device further includes a click system for locking the position of the plate relative to the stand, the click system being arranged in an orifice in a center of the plate, and the click system includes a central disc fixed to the plate and an annular guide plate with a hollow inner wall, an annular area of the orifice being positioned between the central disc and the annular guide plate.

19. The device according to claim 1, wherein said plate is mounted to pivot relative to the stand.

20. The device according to claim 19, wherein the device further includes a click system for locking the position of the plate relative to the stand, the click system being arranged in an orifice in a center of the plate, and the click system includes a central disc fixed to the plate and an annular guide plate with a hollow inner wall, an annular area of the orifice being positioned between the central disc and the annular guide plate.

21. The device according to claim 1, wherein said plate includes five storage surfaces, each being associated with a peripheral support.

22. The device according to claim 1, wherein the U-shaped platform includes two parallel branches, the worm and tube being positioned between the two parallel branches, an upper branch of the two parallel branches forming the top face of the U-shaped platform, and a lower branch of the two parallel branches forming a bottom face of the U-shaped platform.

23. The device according to claim 22, wherein the shim extends from the tube through an opening in the upper branch of the two parallel branches.

* * * * *